US009135799B2

(12) United States Patent
Fraley

(10) Patent No.: US 9,135,799 B2
(45) Date of Patent: Sep. 15, 2015

(54) THEFT DETECTION IN HVAC UNIT HAVING PERSISTENT ALARM

(71) Applicant: XFMRS, Inc., Camby, IN (US)

(72) Inventor: Jon Matthew Fraley, Greenwood, IN (US)

(73) Assignee: XFMRS, Inc., Camby, IN (US)

( * ) Notice: Subject to any disclaimer, the term of this patent is extended or adjusted under 35 U.S.C. 154(b) by 274 days.

(21) Appl. No.: 13/769,091

(22) Filed: Feb. 15, 2013

(65) Prior Publication Data

US 2014/0232542 A1 Aug. 21, 2014

(51) Int. Cl.
*G08B 13/14* (2006.01)
*G08B 13/22* (2006.01)
*G08B 21/18* (2006.01)

(52) U.S. Cl.
CPC ..... *G08B 13/22* (2013.01); *G08B 13/1409* (2013.01); *G08B 21/187* (2013.01)

(58) Field of Classification Search
CPC ..... G08B 13/1409; G08B 21/187
USPC ..... 340/568.1, 568.2, 652; 165/11.1
See application file for complete search history.

(56) References Cited

U.S. PATENT DOCUMENTS 3,289,194 A * 11/1966 King ..... 340/571
4,584,571 A 4/1986 Smit et al.
4,751,499 A 6/1988 Chen
4,816,803 A 3/1989 Brown
5,610,587 A 3/1997 Fujichi et al.
5,844,484 A 12/1998 Fujichi
6,297,963 B1 10/2001 Fogle
6,655,648 B2 12/2003 Harris
6,975,220 B1 12/2005 Foodman et al.
7,187,284 B2 3/2007 Masciantonio
7,274,289 B2 * 9/2007 Kerr et al. ..... 340/500
7,626,487 B2 12/2009 Ogiso
7,812,734 B2 10/2010 Hardin
7,834,772 B2 11/2010 Frederick
8,001,797 B2 8/2011 Tidrick
8,130,100 B2 3/2012 Barger
2002/0079421 A1 6/2002 Harris
2003/0193006 A1 10/2003 Harris
2003/0201892 A1 10/2003 Chance et al.
2004/0221776 A1 11/2004 Martin
2006/0090204 A1 4/2006 Ogiso
2008/0237435 A1 10/2008 Barger
2009/0077984 A1 3/2009 Tidrick
2009/0160661 A1 6/2009 Hardin
2009/0249842 A1 10/2009 Coon
2012/0050050 A1 3/2012 Wojtowicz et al.
2012/0126971 A1 5/2012 Robinson, Jr.
2012/0200413 A1 8/2012 Spurlin
2012/0256746 A1 10/2012 Dunson

* cited by examiner

*Primary Examiner* — John A Tweel, Jr.
(74) *Attorney, Agent, or Firm* — Maginot, Moore & Beck LLP

(57) ABSTRACT

A notification system for an air conditioning system includes a power source, first and second connectors, first and second switches, and a notification device. The power source has first and second power terminals. The first and second connectors are connected to a continuity sensor. The first switching device is configured to connect the first power terminal to a first output responsive to an interruption of current from the first connector to the second connector. The second switching device has a second output coupled to the first output, and is configured to connect the first power terminal to the second output responsive to current on the second output. The notification device is coupled to the first and second outputs, and is configured to generate an audible and/or visible notification responsive to power received from the outputs.

18 Claims, 2 Drawing Sheets

THEFT DETECTION IN HVAC UNIT HAVING PERSISTENT ALARM

FIELD OF THE INVENTION

The present invention relates generally to theft detection, and particularly, for theft detection in HVAC units.

BACKGROUND OF THE INVENTION

Due to the increasing value of commodity metals, such as copper, theft of materials from heating, ventilation and air conditioning ("HVAC") equipment is on the rise. Because material-rich elements of air conditioning systems are typically located outdoors, such elements are especially vulnerable to theft. For example, the exterior unit of a typical residential air conditioning system is located on the ground and external to any building structure. Accordingly, the exterior unit may be readily dismantled for the copper tubing therein without entering the residence itself, and often without disturbing anyone within the residence.

Moreover, such units are in many cases out of immediate plain view from the street and/or within the house. Accordingly, thieves can disassemble the external HVAC unit and remove the copper tubing without easy detection.

To address this issue, systems have been implemented to detect possible theft events in HVAC units, and provide an alarm notification thereof. Many of these systems rely on pressure sensors or movement sensors that indicate when a portion of the air conditioning system is being manipulated or compromised. For example, U.S. Pat. No. 8,001,797 shows a theft detection device that includes a pressure sensor that detects when pressure within the air conditioning line is compromised, thereby indicating a possible theft condition. U.S. Pat. No. 7,812,734 shows a system that detects when copper lines to an air conditioner unit are disconnected or cut, by testing electrical continuity in the copper lines.

Each of these systems has complexity and cost in installation that inhibits their widespread use. For example, the installation of pressure sensors in existing systems, or existing designs of systems, undesirably requires the introduction of parts directly into the pressurized refrigerant line. In addition, testing for tubing electrical continuity requires specialized wiring and interconnection. Many systems further require specific precision installation to avoid making the theft prevention system immune to tampering. For example, U.S. Patent Application Publication No. 2012/0200413 shows a system that tests continuity of a sensor wire that runs to the exterior HVAC unit. That system requires the sensor wire to be taut to avoid quick reconnection by the thief.

There is a need, therefore, for an HVAC theft detection and notification system and method that does not involve expensive or precision installation techniques.

SUMMARY

The present invention addresses the above needs, as well as others, by providing a notification unit that detects a break in continuity in a sensor line that runs between the exterior unit and the interior of the building or facility, and provides a latched alarm notification that cannot be disabled by simply restoring continuity.

A first embodiment is a notification system for an air conditioning system that includes a power source, first and second connectors, first and second switches, and a notification device. The power source has a first power terminal and a second power terminal. The first connector and the second connector are configured to be connected to a continuity sensor coupled to at least a portion of an HVAC system. The first switching device is operably coupled and configured to connect the first power terminal to a first output responsive to an interruption of current from the first connector to the second connector. The second switching device has a second output coupled to the first output, and is configured to connect the first power terminal to the second output responsive to the presence of current on the second output. The notification device has a first terminal coupled to the first output and the second output, and has a second terminal connected to the second power terminal. Preferably, the notification device is configured to generate an audible and/or visible notification responsive to power connected across the first terminal and the second terminal.

The above described features and advantages, as well as others, will become more readily apparent to those of ordinary skill in the art by reference to the following detailed description and accompanying drawings.

DETAILED DESCRIPTION

Figure 1:
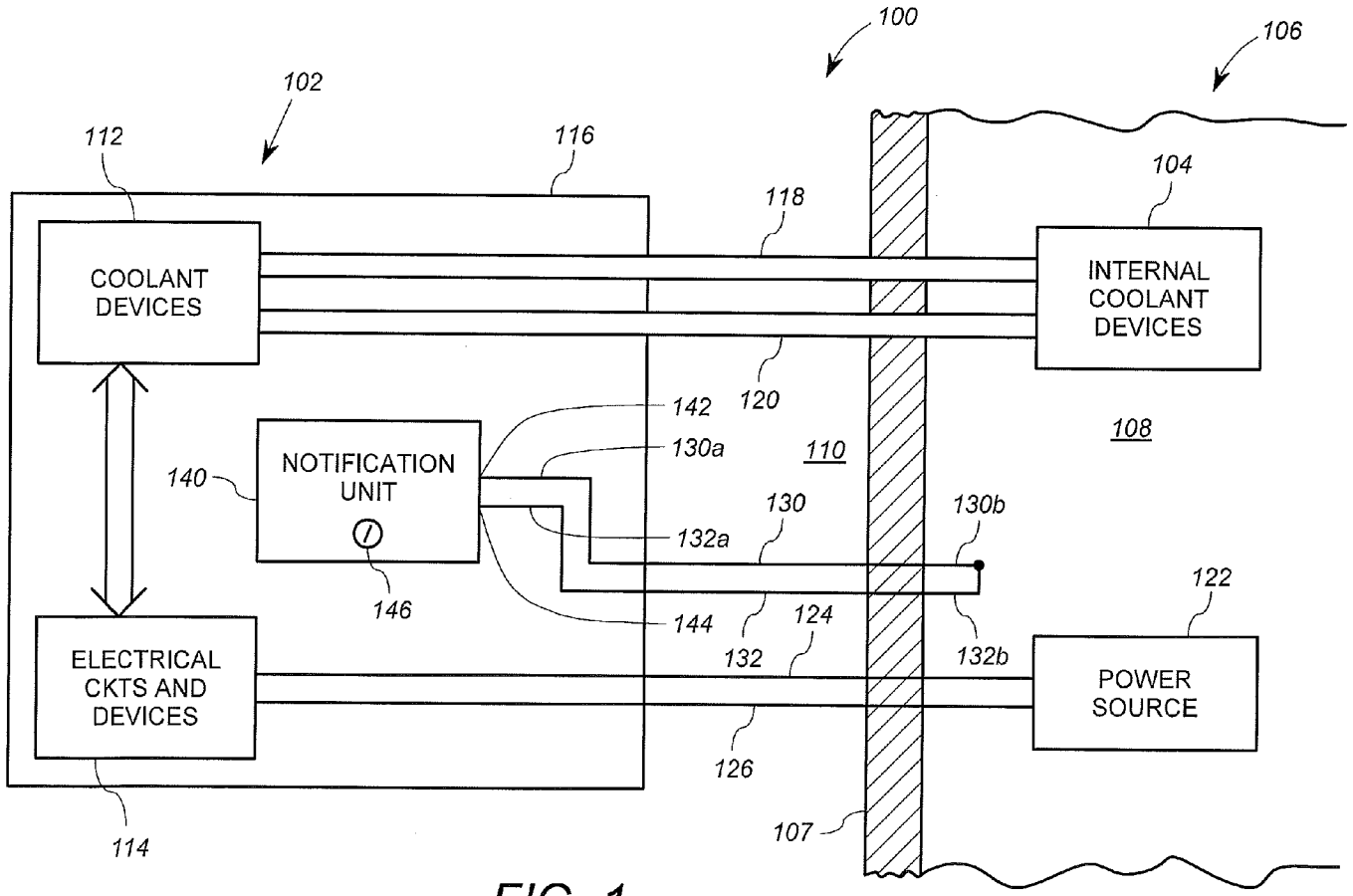
FIG. 1 shows a schematic diagram of an exemplary air conditioning system in which an embodiment of the invention is employed.

FIG. 1 shows an exemplary air conditioning system 100 in which a first embodiment of the invention is employed. The air conditioning system 100 includes an exterior unit 102 and internal coolant elements 104. The air conditioning system 100 is configured to provide cooling within a facility 106 having walls, illustrated in FIG. 1 by example by the wall 107, which separate the interior 108 of the facility 106 and the exterior 110. The facility 106 may suitably be a residence, industrial building or commercial building.

The exterior unit 102, which is disposed external to the interior 108 (separated by the wall 107), includes a housing 116 in which exterior coolant devices 112 and electrical HVAC circuits and devices 114 are disposed. The exterior coolant devices 112 include a condenser and, in many cases, also include a compressor. The exterior coolant devices 112 (and HVAC circuits and devices 114) are constructed at least in part from commodity materials, such as copper, that are desirable for theft. It will be appreciated that the exterior unit 102 may alternatively or in addition include other elements, commodities, or access that attracts potential theft.

In this embodiment, the electrical HVAC circuits and devices 114 include a fan motor, a compressor motor, and drive circuits therefor, not shown. Various implementations of the exterior coolant devices 112 and electrical HVAC circuits and devices 114 would be known to those of ordinary skill in the art.

The exterior coolant devices 112 are operably coupled to exchange refrigerant or coolant fluid with the interior coolant devices 104 via two conduits 118, 120. In particular, the two conduits 118, 120 are configured to transport coolant fluid (in liquid and or gas form) between the internal coolant devices 104 and the exterior coolant devices 112. The two conduits 118, 120 may suitably be formed of copper tubing. The exterior coolant devices 112 may be from any of a number of commercially available air conditioning systems, including those employed for residential or commercial use.

The electrical HVAC circuit 114 are operably coupled to receive power via a power source or power circuit 122 located in the interior 108 of the facility 106. To this end, at least two power conductors 124 and 126 extend from the housing 116, through the wall 107, and to the power source 122 located within the facility 106. The power source 122 may suitably be a connection to the mains AC power system of the facility, or may be a power supply that is connected to the mains AC power system. In this embodiment, the power source 122 is the mains AC electrical system, and the conductors 124, 126 carry approximately 240 volts AC. In the embodiment described herein, the power conductors 124, 126 may suitably be encased in a cable conduit, not shown.

In the embodiment described herein, the exterior unit includes additional sets of conductors 130, 132 extending therefrom, often encased in a conduit, which may be used for other purposes, such as for thermostat operation and/or other optional features. Many commonly available exterior AC units include such cabling/wiring. In some cases, these conductors are in a separate conduit, not shown, but which can be or is typically zip-tied to the conduit that carries the power conductors 124, 126. As will be discussed below, the conductors 130, 132 in the embodiment described herein are configured as described herein to operate as a continuity sensor.

In particular, the conductor 130 has a first end 130*a* and a second end 130*b*, and the second conductor 132 has a first end 132*a* and a second end 132*b*. The conductors 130, 132 extend from the exterior unit 102 to the interior 108. Thus, the first ends 130*a*, 132*a* of the conductors 130, 132 are disposed at or within the housing 116, while the second ends 130*b*, 132*b* are disposed within the facility 106. As discussed above, many installations of air conditioning units may inherently include such conductors. For example, it is known to employ a cable conduit that includes multiple sets of conductors, at least one pair of which may be used as the conductors 130, 132.

According to this embodiment of the invention, the housing 116 of the exterior unit 102 further contains or supports a notification unit 140. The notification unit 140 has a housing on which are supported a first connector 142, a second connector 144 and a key switch 146. The first and second connectors 142, 144 may suitably be screw terminals or other suitable terminals to which wires may be secured. The notification unit 140 also includes circuitry, not shown in FIG. 1 (see FIG. 2), that is configured to detect a break in continuity between the first connector 142 and the second connector 144. The circuitry of the notification unit 140 is further configured to generate an audible and or visible alarm responsive to the detection of the break in continuity, and to maintain the generated alarm in the activated state until the key switch 146 is operated, even if continuity is restored between the first and second connectors 142, 144.

In use, the conductors 130, 132 are employed as a continuity sensor that loops from the exterior unit 102 to the interior 108 of the facility 106 and back. To this end, the second ends 130*b*, 132*b* of the conductors 130, 132 are electrically connected to each other. This may be accomplished by twist-wrapping the bare conductors of the second ends 130*b*, 132*b* around each other. In addition, first end 130*a* of the conductor 130 is connected to the first connector 142, and the first end 132*a* of the conductor 132 is connected to the second connector 144. Accordingly, it will be appreciated that there is electrical connectivity between the first and second connectors 142, 144 via the conductors 130, 132. Thus, in one embodiment wherein the conductors 130, 132 are included as thermostat wires, the thermostat wires are not in use for a thermostat, but rather coupled at their second ends 130*b*, 132*b* to form a conductive loop. It will be appreciated that any conductive loop sensor may be employed, including those that involve the use of the copper fluid conduits 118, 120.

In any event, during normal operation, the notification unit 140 detects the continuity between the first and second connectors 142, 144 and therefore does not produce an alarm notification. Continuity is detected because the loop formed by the conductors 130, 132 remains intact.

It will be appreciated, however, that a theft operation typically involves removing power from the exterior unit 102. To this end, the thief typically cuts the cable conduit that includes the power conductors 124, 126, and any other cables or wires that run between the exterior unit 102 and the interior 108 of facility 106. As a result, the thief also cuts either or both of the conductors 130, 132. When the conductors 130, 132 are cut between the exterior unit 102 and the facility 106, the notification unit 140 detects the discontinuity between the first and second connectors 142, 144 and activates an audible (and/or visible) alarm. In this embodiment, the notification unit 140 maintains the activation of the audible alarm until the key switch 146 is actuated. Thus, even if the continuity between the first and second connectors 142, 144 is re-established, the alarm remains activated until the key switch 146 is operated.

Figure 2:
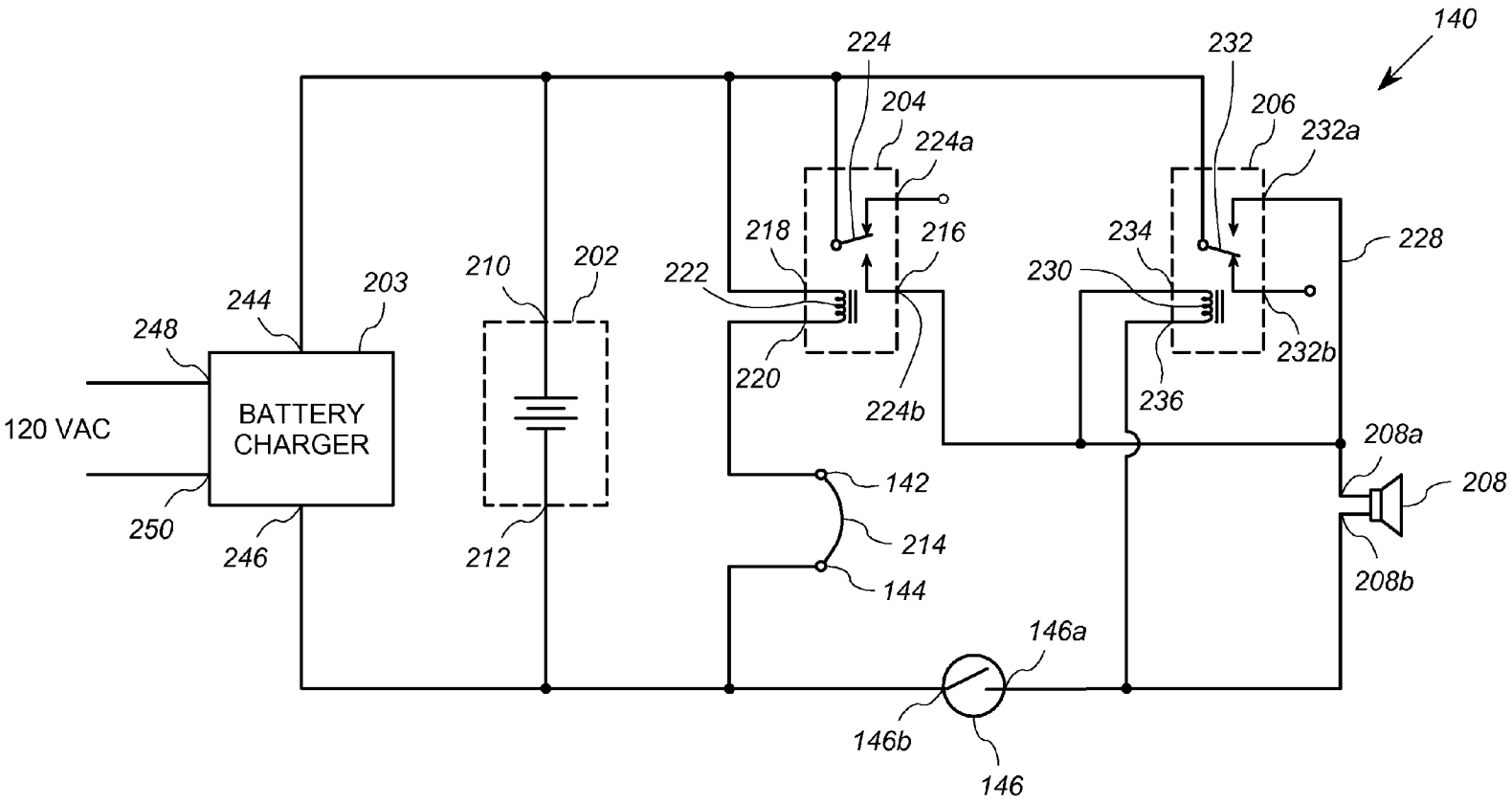
FIG. 2 shows a schematic diagram of a first embodiment of notification system according to the invention.

FIG. 2 shows in further detail an exemplary embodiment of the circuitry of the notification unit 140 of FIG. 1. The notification unit 140 includes a source of electric power 202, the first connector 142, the second connector 144, a first switching device 204, a second switching device 206, and a notification device 208.

The source of electric power 202 includes a first power terminal 210 and a second power terminal 212. The source of electric power (or electric power source) 202 provides the bias power for the operation of the various elements in the notification circuit. In this embodiment, the source of electric power 202 comprises a battery, which allows for operation of the notification unit 140 even when external power is cut from the external unit 102 (as by a thief). In this embodiment, the notification unit 140 further includes a battery charger 203, which is operably connected to receive mains AC voltage from the power lines 124, 126 (see FIG. 1), and to generate a charging voltage to maintain the charge on the power source 202.

As discussed above in connection with FIG. 1, the first connector 142 and the second connector 144 are configured to be connected to a continuity sensor 214 that is mechanically coupled to or supported by at least a portion of an HVAC system. In general, the continuity sensor 214 is arranged such that an attempt to disable or dismantle the exterior unit 102 to remove copper elements therefrom results in the breaking of the continuity in the continuity sensor. As also discussed above, the continuity sensor in FIG. 1 is the pair of conductors 130, 132 (interconnected at the second ends 130*b*, 132*b* thereof). The conductors 130, 132 extend along beside the power conductors 124, 126, such that attempts to disconnect power by cutting the power conductors results in breaking of the continuity from the first end 130*a* of the conductor 130 to the first end 132*a* of the second conductor 132. However, it will be appreciated that the continuity sensor 214 can include or involve other elements that are necessarily disconnected during a common theft operation.

The first switching device 204 has a switched first output 216, and is operably connected to connect the first power terminal 210 to the first output 216 responsive to an interruption of current from the first connector 142 to the second connector 144. In the embodiment described herein, the first switching device 204 comprises a first relay having first and second coil connections 218, 220 and a coil 222 disposed therebetween. The first coil connection 218 coupled to the first power terminal 210 and the second coil connection 220 is coupled to the first connector 142. The second connector 144 is further coupled to the second power terminal 212. Accordingly, continuity between the first connector 142 and the second connector 144 provides energizing power to the coil 222. The first switching device 204 also include a switching element 224 that is coupled to the first power terminal 210, and may be controllably switched between a first contact 224*a* and a second contact 224*b*.

The first switching device 204 is configured such that when the coil 222 is energized, the switching element 224 is decoupled from the first output 216, and when the coil 222 is not energized, the switching element 224 is coupled from the first output 216. To this end, the first switching device 204 may suitably be a single pole, double throw (SPDT) relay. Specifically, an SPDT relay as the first switching device 204 connects the switching element 224 to the first contact 224*a* when the coil 222 is energized, and connects the switching element 224 instead to the second contact 224*b* when the coil is de-energized. The first contact 224*a* is open circuited, and the second contact 224*b* is coupled to (or itself constitutes) the first output 216.

The second switching device 206 is a latching device configured to transition from a first state to a latched state responsive to the first switching device 204 transitioning to the connected state (i.e. when the switching element 224 is coupled to the first output 216), and configured to remain in the latched state then the first switching device 204 transitions from the connected state to the open state. In the first state, the second switching device 206 does not provide a connection from the first power terminal 210 to a first terminal 208*a* of the notification device 208. In the latched state, the second switching device 206 operably connects the first power terminal 210 to the first terminal 208*a* of the notification device 208.

To this end, the second switching device 206 has an output 228 coupled to the first output 216, and is configured to connect the first power terminal 210 to the second output 228 responsive to the presence of current on or through the second output 228. In the embodiment described herein, the second switching device comprises a SPDT relay having a coil 230, a switching element 232, first and second coil connections 234, 236, and first and second contacts 232*a*, 232*b*. In general, the coil 230 is configured to be energized when current flows between the first and second coil connections 234, 236. Moreover, the coil 230 is configured to connect the switching element 232 to the first contact 232*a* when energized. The switching element 232 otherwise connects to the second contact 232*b* when the coil 230 is not energized.

In this embodiment, the first coil connection 234 is coupled to the first output 216 and second output 228, and the second coil connection 236 is coupled to the second power terminal 212 via the key switch 146. To this end, the second coil connection 236 is coupled to a first terminal 146*a* of the key switch 146, and the second power terminal 212 is coupled to a second terminal 146*b* of the key switch 146. The switching element 232 is coupled to the first power terminal 210, and, as discussed above, connects to one of the first contact 232*a* and the second contact 232*b* depending on whether the coil 230 is energized. The first contact 232*a* is coupled to the second output 228, which in turn is connected to the first terminal 238 of the notification device 208. The second contact 232*b* is open-circuited. Thus, when the coil 230 is energized, the second switching device (or latching device) 206 connects the first power terminal 210 to a first terminal 208*a* of the notification device 208. When the coil 230 is not energized, the second switching device 206 does not connect the first power terminal 210 to the first terminal 208*a* of the notification device 208.

The notification device 208 is a device that is configured to produce an audible and/or visible signal when electrical power is applied thereto. In addition to the first terminal 208*a*, the notification device 208 includes a second terminal 208*b*. The notification device 208 is configured to provide the audible and/or visual notification responsive to electrical power being applied across the first and second terminals 208*a*, 208*b*.

In this embodiment, the notification device is a 12 volt siren device, such as the 273-057 model siren available from Radio Shack. As discussed above, the first terminal 208*a* of the notification device 208 is operably coupled to the first output 216, the second output 228 and the first coil contact 234 of the second switching device 206. The second terminal 208*b* is coupled to the second power terminal 212 via the key switch 146. Accordingly, the second terminal 208*b* is coupled to the first terminal 146*a* of the key switch 146.

As discussed above, in the embodiment described herein, the notification unit 140 further includes the 12 volt battery charger 203, having charging outputs 244, 246 coupled to, respectively, the first and second terminals 210, 212 of the electric power source 202, and AC voltage inputs 248, 250. The 12 voltage battery charger 203 is any suitable battery charging circuit that is configured to receive AC voltage and provide sufficient DC voltage output to charge a 12 volt battery or battery circuit. Such devices are conventional. The AC voltage inputs 248, 250 are operably coupled to receive 115-120 volts AC from a building electrical system and generate DC charging current and voltage therefrom. The battery charger 203 allows the electric power source 202 to maintain sufficient power to operate over prolonged periods. Without the battery charger 203, the useful operational life of the notification unit 140 would be limited.

In operation, the notification unit 140 has three general states, armed (normal), on (alarm condition), and off (deactivated). In general, the notification unit 140 transitions from the armed state to the on state when it detects an interruption in continuity between the first and second connections 142, 144. The notification unit 140 transitions from the on state to the off state when the key switch 146 is manipulated to an off position. The notification unit 140 is in the armed state at any time when the key switch 146 is in the on position and continuity between the connections 142, 144 is detected.

In further detail, during normal operation, the notification unit 140 is in the armed state. In such a condition, the continuity sensor 214 (e.g. the conductor loop 130, 132 of FIG. 1) is coupled between (and provides a continuous connection between) the first and second connectors 142, 144. In addition, the key switch 146 is closed, thereby connecting the first and second terminals 146*a*, 146*b* thereof. The electric power source 202 provides DC voltage between its first power terminal 210 and its second power terminal 212.

Because the continuity sensor 214 is intact, a circuit loop is formed from the first power terminal 210 through the coil 220, through the continuity sensor 214, to the second power terminal 212. As a consequence, the coil 220 is energized. Because the coil 220 is energized, the switching element 224 of the first switching device 204 electrically connects the first power terminal 210 to the first contact 224*a*. The first contact 224*a* is open circuited. The second contact 224*b*, which is connected to the first output 216, is not connected to the first power terminal 210 when the coil 220 is energized. Accordingly, no voltage or current reaches the first output 216 through the first switching device 204.

Because no voltage or current is present on the output 216, the first coil contact 234 of the second switching device 206 does not receive any voltage or current. As a consequence, no current passes from the first coil contact 234 to the second coil contact 236 via the coil 230, and the coil 230 is not energized. Because the coil 230 is not energized, the switching element 232 couples the first power terminal 210 to the second contact 232*b*. The second contact 232*b* is open circuited. Because the switching element 232 does not connect the first power terminal 220 to the first contact 232*a*, no voltage or current reaches the second output 228 via the second switching device 206.

Because not voltage or current reaches the first output 216 or the connected second output 228, no voltage is present across the notification device 208. As a consequence, the notification device 208 does not provide any audible and/or visible alarm notification.

If a theft is attempted, the attempt will often result in a break in the continuity sensor 214, thereby creating an open circuit between the first connection 142 and the second connection 144. For example, referring to FIG. 1 in which the continuity sensor 214 is formed by the conductors 130, 132, which have been interconnected at their far ends 130*b*, 132*b*. A theft attempt will involve disconnection of the power conductors 124, 126 and any other wires that emanate from the housing 116. Because the power conductors 124, 126 and the conductors 130, 132 both extend from the housing 116 (typically from the same point of entry), the theft attempt will usually involve cutting through the conductors 130, 132 as well as the power conductors 124, 126. As a result of the severing of the conductors 130, 132, the conductors 130, 132 no longer form a continuous electrical loop from the first connector 142, through the conductor 130 to the end 130*b* within the facility 106, through the conductor 132 back to the second connector 144.

Referring back to FIG. 2, it will be appreciated that other types of continuous conductive loops or paths may be employed as the continuity sensor 214. When the continuity between the first connector 142 and 144 is interrupted, there is no longer a conductive path from the first power terminal 210 to the second power terminal 212 through the coil 220 of the first switching device 204. As a consequence, the coil 220 is de-energized and the switching element 224 switches to the second contact 224*b*. As a result, the first power terminal 210 is connected to the second contact 224*b*, and hence the first output 216 and second output 228.

The resulting voltage at the first output 216 forms a circuit path through the first coil contact 234 of the second switching device 206, through the coil 230, through the second coil contact 236, and back to the second power terminal 212 via the closed key switch 146. As a consequence, the coil 230 of the second switching device 206 is energized. Because the coil 230 is energized, the switching element 232 switches to the first contact 232*a*. As a consequence, the first power terminal 210 is connected to the second output 228 (and hence first output 216) via the second switching device 206.

By virtue of the first power terminal 210 being connected to the outputs 216, 228 through both (or either) the first switching device 204 and the second switching device 206, a voltage is present at the first terminal 208*a* of the notification device 208. The voltage across the first terminal 208*a* and the second terminal 208*b* causes activation of the notification device 208, and the activation of the audible and/or visible alarm. The notification unit 140 is, thereby, in the on-state.

During the on-state, connectivity between the first and second connections 142, 144 may be restored. However, this action alone will not transition the notification unit 140 away from the on-state, nor stop the audible and/or visible alarm. Instead, if the connection between the first and second connections 142, 144 is re-established, a circuit path is again created through the coil 220. The coil 220 thereby energizes, causing the switching element 224 to move the connection of the first power terminal 210 to the open-circuited first contact 224*a*, and off of the second contact 224*b*. As a consequence, no circuit path is established from the first power terminal 210, through the notification device 208, to the second power terminal 212 through the first switching device 204. However, a circuit path remains from the first power terminal 210 to the notification device 208 and the second power terminal 212 via the second switching device 206.

In particular, when the first switching device 204 removes the connection from the first power terminal 210 to the first output 216 via the switching element 224, the first power terminal 210 nevertheless remains connected to the first output 216 (via second output 228) via the second switching device 206. As a result, the voltage from the first power terminal 210 propagates through the switching element 232 to the second output 228 (and first output 216) to the coil connection 234, the coil 232, and the second coil connection 236. The completed circuit path from the first power terminal through the coil 232 to the second power terminal 212 through the key switch 146 keeps the coil 230 energized. Because the coil 230 remains energized, the switching element 232 remains connected to the first output 232*a*, and the first power terminal 210 remains connected to the second output 228. In this manner, the configuration of the second switching device 206 operates as a latch—once it is closed, it holds itself closed regardless of a change in the original "input".

Because power thereafter remains present at the first and second outputs 216, 228, respectively, power also remains present across the notification device 208. Thus, the second switching device 206 maintains the notification device 208 in the activated state even after continuity is restored between the first connection 142 and 144.

In order to reset the alarm and deactivate the notification device, the key switch 146 is operated from the closed position to the open position. Such operation creates an open circuit between the terminals 146*a*, 146*b*. As discussed above, the key switch 146 may be physically actuated using a key device, or may be operated by any other suitable security key, including but not limited to a code value received via from a keypad, or an RF signal including a key code.

Once the circuit is opened between the terminals 146*a*, 146*b*, no circuit can be completed through the notification device 208 and the audible and/or visible alarm is discontinued. In addition, no circuit can be completed through the coil 230 and thus the coil 230 is deenergized. When the coil 230 is de-energized, the switching element 232 reverts to connect the first power terminal 210 to the open-circuited second contact 232*b*. As a consequence, the "latch" of the second switching device 206 has been "reset". The notification unit 140 in such a condition is in the off-state.

When the key switch 146 is closed again, then the notification unit 140 re-enters the "armed" state if continuity has been restored between the first connection 142 and the second connection 144. If continuity has not been restored when the key switch 146 is closed, then the notification unit 140 returns to the on-state.

The above described embodiment thus provides a method and arrangement in which an interruption in electrical continuity between a facility and an exterior AC unit may be detected and alarmed. Moreover, the above-described embodiment provides a latching functionality that prevents a thief from quickly deactivating the alarm by re-establishing continuity either by using a bypass connection or actually reconnecting the continuity sensor 214.

It will be appreciated that the above-describe embodiments are merely illustrative, and that those of ordinary skill in the art may readily devise their own implementations and modifications that incorporate the principles of the invention and fall within the spirit and scope thereof. For example, it is possible that one or more of the switching devices 204, 206 may be replaced by other switching devices having analogous operation. Moreover, the use of a 12 volt circuit is given by way of example only.

I claim:

1. A notification system for an air conditioning system, comprising:

a source of electric power having a first power terminal and a second power terminal;

a first connector and a second connector configured to be connected to a continuity sensor;

a first switching device, the first switching device operably coupled and configured to connect the first power terminal to a first output responsive to an interruption of current from the first connector to the second connector;

a second switching device having a second output coupled to the first output, the second switching device configured to connect the first power terminal to the second output responsive to the presence of current on the second output;

a notification device having a first terminal coupled to the first output and the second output, and having a second terminal connected to the second power terminal.

2. The notification system of claim 1, further comprising a housing supporting at least the first switching device and the second switching device, the housing disposed within a condenser unit of an HVAC system located exterior to a facility in which another portion of the HVAC system resides.

3. The notification system of claim 2, further comprising the continuity sensor, the continuity sensor comprising a conductor loop having a first end, a second end, and an intermediate loop therebetween, the first end connected to the first connector, the second end connected to the second connector, and the intermediate loop portion extending from the housing to the facility and back.

4. The notification system of claim 2, wherein the first switching device comprises a first relay having first and second coil connections and a coil disposed therebetween, the first coil connection coupled to the first power terminal and the second coil connection coupled to the first connector, and wherein the second connector is further coupled to the second power terminal.

5. The notification system of claim 4, wherein the first relay is operably coupled to disconnect the first power terminal from the first output responsive to current flowing through the coil.

6. The notification system of claim 5, wherein the second switching device operates as a latch.

7. The notification system of claim 5, wherein the second switching device comprises a second relay having third and fourth coil connections and a second coil disposed therebetween, the third coil connection coupled to the second output and the fourth coil connection coupled to the second terminal of the notification device.

8. The notification system of claim 7, wherein the each of the first relay and the second relay comprises a single pole, double throw relay.

9. The notification system of claim 1, further comprising a turn-off switch coupled between second terminal of the notification device and the second power terminal.

10. The notification system of claim 9, wherein the turn-off switch comprises a key-operated switch.

11. The notification system of claim 1, wherein the source of electric power comprises a battery.

12. The notification system of claim 11, further comprising a battery charger coupled to the battery.

13. A method for detecting activity in an air conditioning system, comprising:

providing electric power between a first power terminal and a second power terminal;

extending a continuity sensor in a conduit extending from an exterior unit of an HVAC system to a location within a facility;

providing a first switching device, the first switching device operably configured to transition from an open state to a connected state responsive to an interruption of current through the continuity sensor, wherein the first switching device connects the first power terminal to a first output in the connected state;

providing a latching device configured to transition from a first state to a latched state responsive to the first switching device transitioning to the connected state, and wherein the latching device remains in the latched state when the first switching device transitions from the connected state to the open state, and where the latching device connects the first power terminal to the first output in the latched state; and activating a notification device responsive to a voltage at the first output.

14. The method of claim 13, wherein:

the first switching device does not connect the first power terminal to the first output in the open state; and the latching device does not connect the first power terminal to the first output in the first state.

15. The method of claim 13, further comprising supporting at least the first switching device and the latching switching device in a housing disposed within a condenser unit of an HVAC system located exterior the facility.

16. The notification system of claim 15, wherein the continuity sensor comprises a conductor loop having a first and second ends terminated on or within the housing, and an intermediate loop portion that extends from the housing to the facility and back.

17. The notification system of claim 16, wherein the first switching device comprises a first relay having first and second coil connections and a coil disposed therebetween, the first coil connection coupled to the first power terminal and the second coil connection coupled to the continuity sensor, and wherein the continuity sensor is further coupled to the second power terminal.

18. The notification system of claim 17, further comprising providing a key-operated turn-off switch coupled between the notification device and the second power terminal.

* * * * *